US006547613B1

(12) United States Patent
Onoue et al.

(10) Patent No.: US 6,547,613 B1
(45) Date of Patent: Apr. 15, 2003

(54) MARINE DRIVE TRANSMISSION

(75) Inventors: Akihiro Onoue, Hamamatsu (JP); Hisayoshi Yoshino, Hamamatsu (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/606,622

(22) Filed: Jun. 29, 2000

(30) Foreign Application Priority Data

Jun. 30, 1999 (JP) ..... 11-186192

(51) Int. Cl.[7] ..... B63H 23/32
(52) U.S. Cl. ..... 440/83; 440/75
(58) Field of Search ..... 440/83, 75; 464/162, 464/169

(56) References Cited

U.S. PATENT DOCUMENTS 3,908,401 A * 9/1975 Harbage
4,747,796 A 5/1988 Iwai et al.
4,787,868 A 11/1988 Hoshiba et al.
4,820,210 A * 4/1989 Dretzka ..... 440/75
5,050,446 A 9/1991 Takashima et al.
5,074,812 A 12/1991 Watanabe
5,224,898 A * 7/1993 Johnson et al. ..... 464/169
5,415,575 A * 5/1995 Karls ..... 440/75
6,322,407 B1 * 11/2001 Onoue et al. ..... 440/52

* cited by examiner

*Primary Examiner*—Sherman Basinger
(74) *Attorney, Agent, or Firm*—Knobbe, Martens, Olson & Bear, LLP.

(57) ABSTRACT

A power transmission system for a marine propulsion unit includes an improved construction that can absorb a shock generated when a shift mechanism is operated. The propulsion unit has a powering element and a propulsion device. The power transmission system includes a first shaft driven by the powering element and a second shaft driven by the first shaft and driving the propulsion device. The first and second shafts have a common axis. A coupling assembly is mounted on both the first and second shafts so as to couple them for rotation together. A damper is disposed next to the coupling assembly. The coupling assembly includes a pair of coupling members. One of the coupling members is axially moveable along the common axis relative to the other coupling member to compress the damper at the moment the first shaft is rotated relative to the second shaft. In another arrangement, a lost motion mechanism operates when the first shaft is rotated relative to the second shaft such that the initial shock is damped.

24 Claims, 9 Drawing Sheets

MARINE DRIVE TRANSMISSION

PRIORITY INFORMATION

This inventions based on and claims priority to Japanese Patent Application No. Hei 11-186192, filed Jun. 30, 1999, the entire contents of which is hereby expressly incorporated by reference.

BACKGROUND OF THE INVENTION

1. Field of the Invention

This invention relates to a marine drive transmission, and more particularly to an improved marine drive transmission that absorbs a shift shock.

2. Description of Related Art

A wide variety of marine propulsion units propel watercraft. For instance, outboard motors commonly power boats and other watercraft. Stern drive units, which include an inboard motor and an outboard drive, also are often used to power boats and watercraft.

A typical outboard motor includes a power head atop a drive unit. The power head includes an internal combustion engine having an output shaft extending generally vertically. A driveshaft housing depends from the power head and encloses a driveshaft that extends generally vertically from the output shaft. A lower unit further depends from the driveshaft housing. A propulsion shaft is provided therein and extends generally horizontally. The driveshaft and the propulsion shaft are coupled together within the lower unit so that the propulsion shaft extends normal to the driveshaft. A propulsion device, such as, for example, a propeller is affixed to an outer end of the propulsion shaft. A bevel gear transmission, for example, is provided between the driveshaft and the propulsion shaft and includes a forward, neutral, reverse shift mechanism for moving between forward, neutral and reverse positions. The engine powers the propeller through the driveshaft, bevel gear transmission and propulsion shaft. The propeller, thus, can propel the outboard motor and the associated watercraft in both forward and reverse directions, unless the shift mechanism is in the neutral position.

An outboard section of the stem drive unit has a construction similar to that of the outboard motor except that the engine is not positioned over the propulsion device. The engine is placed in the hull of the watercraft. A propulsion device of the stern drive unit, which typically is a propeller, is powered by the engine through the driveshaft and propulsion shaft combination (i.e., drive train arrangement) similar to that of the drive unit of the outboard motor.

Users continue to desire more powerful marine drives and prefer large propulsion units having engines which produce higher horsepower. An engine, for example, which operates on a four-stroke combustion principle and having multiple cylinders, can provide the desired increased horsepower.

However, when engaging these larger engines, the marine propulsion unit tends to jolt the occupants of the watercraft. The sudden movement gives the occupants an uncomfortable feeling. In other words, because the large-sized engine generates a relatively strong propulsive force, an uncomfortable shock is created by the abrupt change in direction of the propulsive force, particularly when the shift mechanism is shifted from the neutral position to the forward drive position or to the reverse drive position.

In order to address this problem, a shock absorbing device for the shift mechanism has been proposed in U.S. Pat. No. 4,747,796. FIGS. 1 and 2 illustrate this type of coupling. FIG. 1 is a cross-sectional, side elevational view of a transmission coupling 20 arranged to absorb the shock, and FIG. 2 is a cross-sectional view of the coupling 20 taken along the line 2—2 of FIG. 1.

With reference to these figures, a driveshaft 22 is divided into a drive section 24 and a driven section 26 and the coupling 20 joins these sections. The lower end of the drive section 24 has a depending socket 28 that defines an internal cavity 30. An upper end portion 32 of the driven section 26 extends into the cavity 30. Three blocks of elastic members 34 are interposed between the internal cavity 30 and the end portion 32. As seen in FIG. 2, the socket 28 and its internal cavity 30 have a generally triangular configuration in section. The end portion 32 has a complementary triangular shape featuring three points 38.

The coupling 20 provides vibration damping and force absorption under a low speed and low load condition. This damping is provided by the compressible elastic members 34. When the driving load increases, the elastic members 34 are increasingly compressed and the points 38 of the projecting portion 32 directly contact the inner cavity 30 of the socket 28. The torque of the drive section 24 is transmitted to the driven section 26 through this connection.

Because the transmission shift shock occurs under low speeds, the coupling 20 is quite useful for preventing the shock. However, another problem arises with this coupling 20, namely, the driving force cannot be securely transferred from the drive section 24 to the driven section 26 when the driving load increases, because the driving force is conveyed to the inner cavity 30 by the contacts of the points 38 and these contacts are unreliable. Of course, the elastic members 34 also are involved in this force transferring mechanism; however, the elastic members 34 tend to slip within the cavity 30 and do not increase reliability.

SUMMARY OF THE INVENTION

Increasing the contact areas between the points 38 and the cavity 30 or using elastic members that have larger volumes could resolve the above-identified problems. Both of the improvements, however, would require enlarging the surrounding housing and would thereby interfere with the arrangement of other components disposed proximate the housing.

A need therefore exists for a marine drive transmission that can absorb a shock generated when a shift mechanism is operated. The transmission preferably has a compact structure comprising a coupling that can securely transmit the driving force from a drive section to a driven section after operation of the shift mechanism.

In accordance with one aspect of the present invention, a power transmission system for a marine propulsion unit is provided. The marine propulsion unit has a powering element and a propulsion device. The power transmission system comprises a first shaft driven by the powering element, and a second shaft driven by the first shaft and driving the propulsion device. The first and second shafts have a common axis. A coupling assembly is mounted on both the first and second shafts so as to couple the first and second shafts for rotation together. A damper is disposed next to the coupling assembly. The coupling assembly includes a pair. of coupling members. One of the coupling members is axially moveable along the common axis relative to the other coupling member to compress the damper at the moment the first shaft begins to drive the second shaft.

In accordance with another aspect of the present invention, a coupling for a power transmission is provided.

The power transmission has a drive shaft and a driven shaft. The coupling comprises a first member. The first member is rotatable together with one of the drive shaft and the driven shaft and has at least one tooth extending axially. The coupling comprises also a second member. The second member is rotatable together with the other shaft and has at least one tooth extending axially to engage with the tooth of the first member. A damper is disposed next to the second member. Confinement members confine the first member, second member and the damper therebetween. The second member compresses the dampers when the drive shaft begins to rotate the driven shaft.

In accordance with a further aspect of the present invention, a marine drive comprises a shaft. The shaft includes a first section driven by a prime mover and a second section driven by the first section to drive a propulsion mechanism. A first coupling member is connected to one of the first and second sections by spline connection. A second coupling member is connected to the other section by spline connection. Both the first and second coupling members are coupled with each other. A shock absorber is disposed adjacent to the second coupling member. The second coupling member bumps into the shock absorber when the first section starts rotating the second section that has been at a standstill.

Further aspects, features and advantages of this invention will become apparent from the detailed description of the preferred embodiments which follow.

BRIEF DESCRIPTION OF THE DRAWINGS

As noted above, FIG. 1 is a cross-sectional, side elevational view showing the coupling. FIG. 2 is a cross-sectional view showing the coupling taken along the line 2—2 of FIG. 1. These figures are provided in order to assist the reader's understanding of the prior art and for the reader to better appreciate the aspects, features and advantages associated with the present invention.

DETAILED DESCRIPTION OF THE PREFERRED EMBODIMENTS OF THE INVENTION

Figure 1:
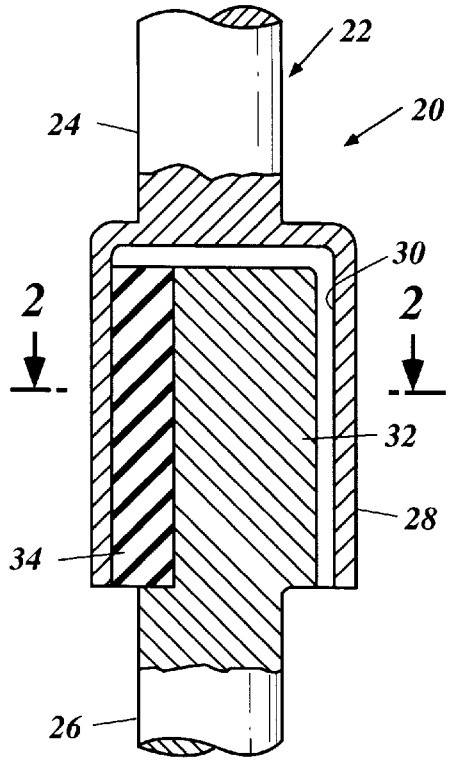
Figure 1 Prior Art
FIG. 1 and 2 illustrate a conventional coupling.
Figure 2:
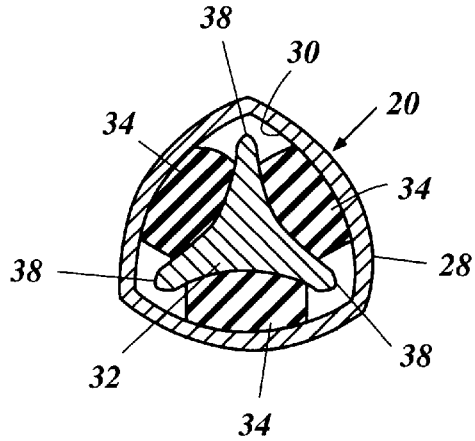
Figure 2 Prior Art
Figure 3:
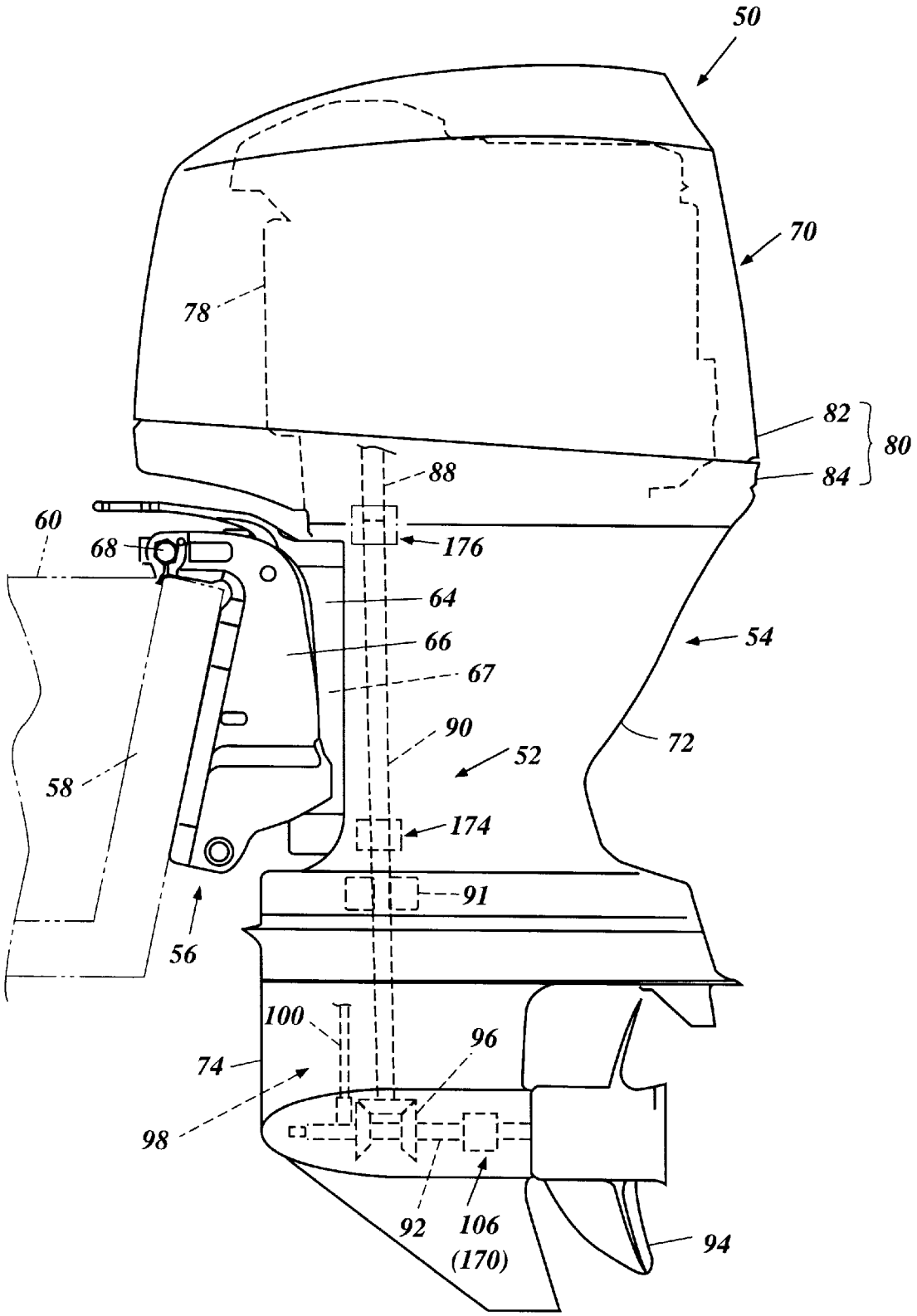
FIG. 3 is a side elevational view of an outboard motor that uses a power transmission) system configured in accordance with certain aspects, features and advantages of the present invention. An associated watercraft is shown in phantom.

With reference to FIG. 3, an outboard motor 50 having a power transmission system 52 configured in accordance with certain aspects, features and advantages of the present invention is illustrated therein. Although the present invention has particular applicability in connection with an outboard motor, and therefore is described in this context, certain aspects of the present invention can be used with other marine drive units as well (e.g., a stern drive unit).

The outboard motor 50 comprises a drive unit 54 and a bracket assembly 56. The bracket assembly 56 supports the drive unit 54 on a transom 58 of an associated watercraft 60 so as to place a marine propulsion device of the drive unit 54 in a submerged position with the watercraft 60 resting on the surface of a body of water. The bracket assembly 56 comprises a swivel bracket 64, a clamping bracket 66, a steering shaft 67 and a pivot pin 68.

The steering shaft 67 extends through the swivel bracket 64 and is affixed to the drive unit 54. The steering shaft 67 is pivotally journaled for steering movement about a generally vertically extending steering axis within the swivel bracket 64. The clamping bracket 66 includes a pair of bracket arms spaced apart from each other and affixed to the watercraft transom 58. The pivot pin 68 completes a hinge coupling between the swivel bracket 64 and the clamping bracket 66. The pivot pin 68 extends through the bracket arms so that the clamping bracket 66 supports the swivel bracket 64 for pivotal movement about a generally horizontally extending tilt axis of the pivot pin 68. Although not shown, the bracket assembly 56 can include a hydraulic tilt system that is provided between the swivel bracket 64 and clamping bracket 66. This system tilts up and down and also adjusts the trim position of the drive unit 54.

As used through this description, the terms "front," "forward " and "forwardly" mean at or to the side where the clamping bracket 66 is located, and the terms "reverse," "rear," "rearward" and "rearwardly" mean at or to the opposite side of the front side, unless indicated otherwise.

Since the construction of the bracket assembly 56 is well known in the art, further description is not believed necessary to permit those skilled in the art to practice the present invention.

The drive unit 54 includes a power head 70, a driveshaft housing 72 and a lower unit 74. The power head 70 is disposed atop the drive unit 54 and includes an internal combustion engine 78 and a protective cowling assembly 80 that surrounds the engine 78.

The protective cowling assembly 80 includes a top cowling member 82 and a bottom cowling member 84. The top cowling member 82 has an air intake opening through which the ambient air can be taken into a generally closed cavity defined within the cowling member 82. The engine 78 has an air intake system that introduces the air into a combustion chamber of the engine 78 for combustion, as is well known in the art. The top cowling member 82 is detachably affixed to the bottom cowling member 84 so that the operator can access the engine 78 for maintenance or other purposes. The bottom cowling member 84 has an opening at its bottom portion through which an exhaust guide extends. The exhaust guide generally is affixed atop the driveshaft housing 72. The bottom cowling member 84 and the exhaust guide, thus, generally form a tray. The engine 78 is placed on this tray and is affixed to the exhaust guide. The exhaust guide has an exhaust passage that forms a portion of an exhaust system of the engine 78.

The engine 78 operates on, for example, a four-stroke combustion principle and powers a propulsion device. Various types of engines that have a sole cylinder or multiple cylinders arranged in various ways and that operate on other combustion principles (e.g., crankcase compression two-stroke or rotary) also are practicable. Moreover, even an electric motor is applicable as a prime mover of the propulsion device in practicing the invention.

The engine 78 has an output shaft or crankshaft 88 that rotates when the engine 78 operates. Generally, a rotational speed of the output shaft 88, or the engine speed, is controlled by a suitable mechanism. In the illustrated arrangement, the engine speed is controlled by a throttle valve mechanism. The throttle valve mechanism includes a throttle valve disposed in the air intake system so that an amount of an air charge is accurately measured by an opening of the throttle valve in response to various states of engine operations. The engine also has a fuel supply system. An amount of a fuel charge is also measured in proportion to the air amount. An engine speed of the engine 78 increases or decreases based upon the air/fuel charge amount. Because the engine construction is well known, further descriptions thereof are not believed necessary to permit those skilled in the area to practice the invention.

The driveshaft housing 72 depends from the power head 70 and supports a driveshaft 90, which is driven by the output shaft 88 of the engine 78. The driveshaft 90 extends generally vertically through the exhaust guide and the driveshaft housing 72. The drive shaft housing 72 also defines internal passages which form portions of the exhaust system. Additionally, the engine 78 normally has a cooling system that cools portions of the engine and the exhaust system with water that is introduced from the body of water in which the watercraft is operating. The cooling system includes a water pump 91 that is disposed in the driveshaft housing 72. The water pump 91 is driven by the driveshaft 90.

The lower unit 74 depends from the driveshaft housing 72 and supports a propulsion shaft 92 which is driven by the driveshaft 90. The propulsion shaft 92 extends generally horizontally through the lower unit 74. In the illustrated arrangement, the propulsion device includes a propeller 94 that is affixed to an outer end of the propulsion shaft 92 and that is driven by the shaft 92. The propulsion device, however, can take the form of a dual, counter-rotating propeller system, a hydrodynamic jet, or any other suitable propulsion device.

A bevel gear transmission 96 is provided between the driveshaft 90 and the propulsion shaft 92. The bevel gear transmission 96 couples together the two shafts 90, 92 which lie generally normal to each other (i.e., at a 90° shaft angle). The transmission 96 includes a forward, neutral, reverse shift mechanism 98 to shift rotational directions of the propeller 94 (forward and reverse positions) or to uncouple the propeller 94 from the engine 78 (a neutral position). The shift mechanism 98 has a shift rod 100 extending generally vertically toward the power head 58 through the steering shaft in the illustrated arrangement. A shift cable (not shown) is coupled with the shift rod 100 and extends generally forwardly through the bottom cowling 84 so that the operator can select one of the shift positions through movement of the shift cable. The bevel gear transmission 96, including the shift mechanism 98, is similar to that illustrated in FIG. 13, which will be described later.

Figure 4:
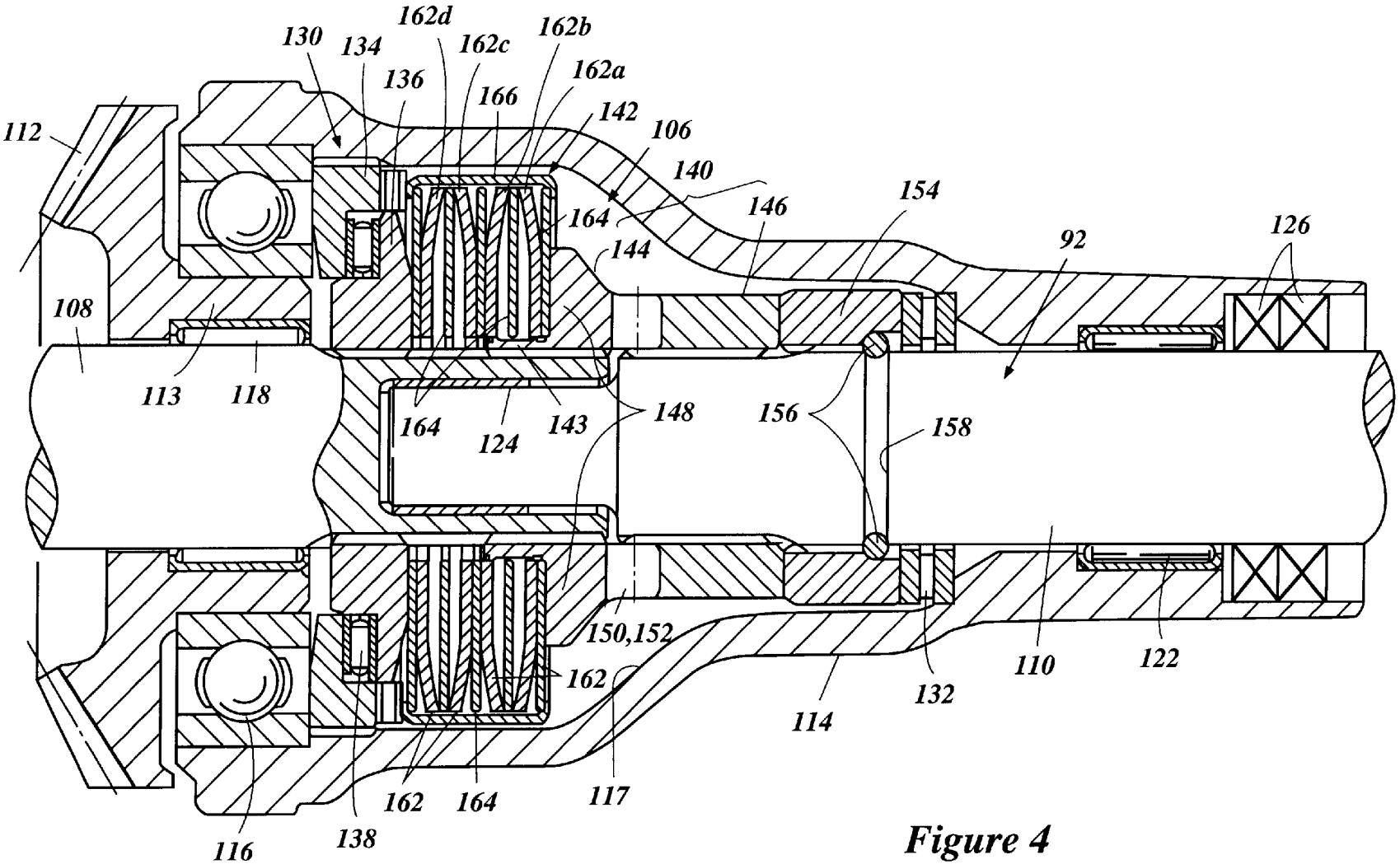
FIG. 4 is a cross-sectional, side elevational view of a transmission coupling of the power transmission system.
Figure 5:
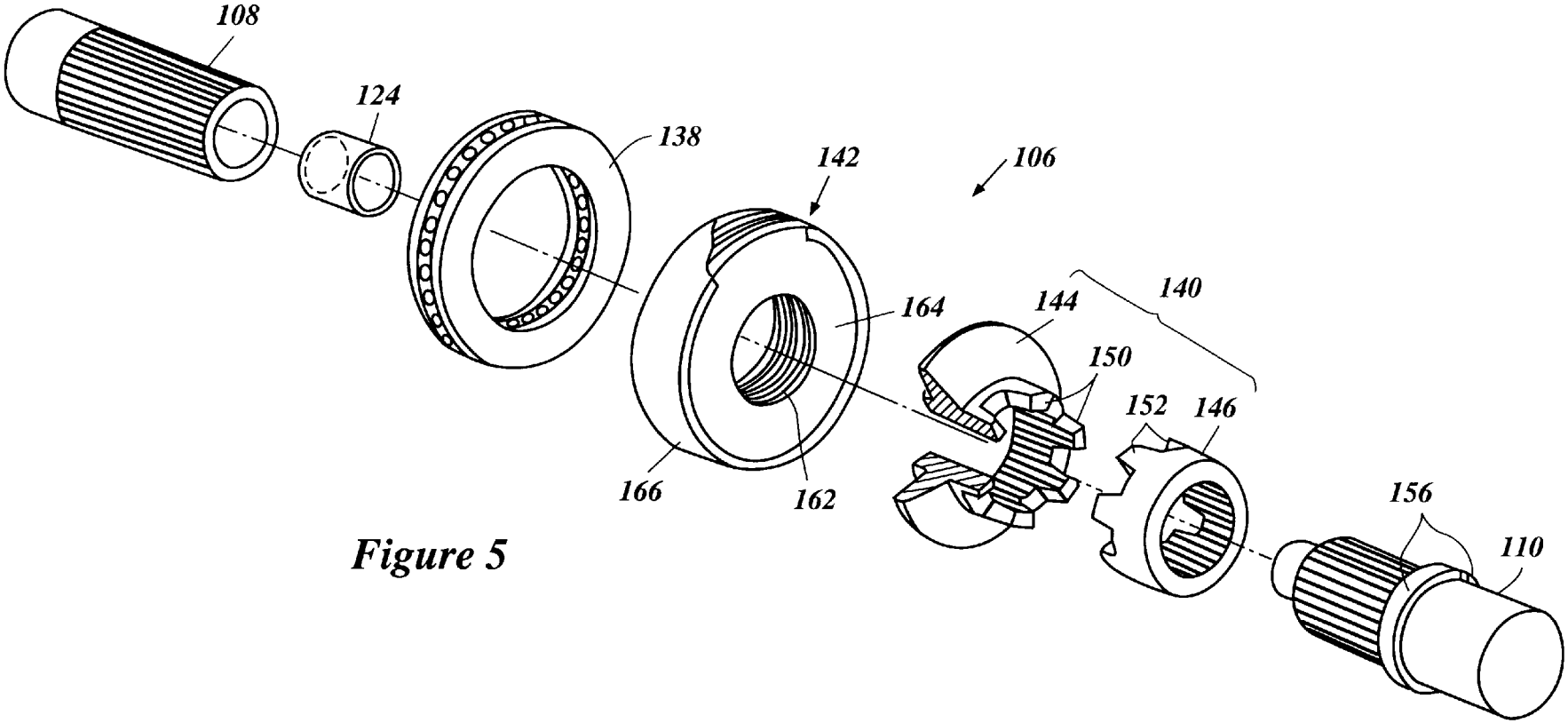
FIG. 5 is an exploded perspective view of several components that form the propulsion shaft and the transmission coupling. A spacer, an outer holder and an inner holder of a bearing assembly are omitted in this figure.
Figure 6:
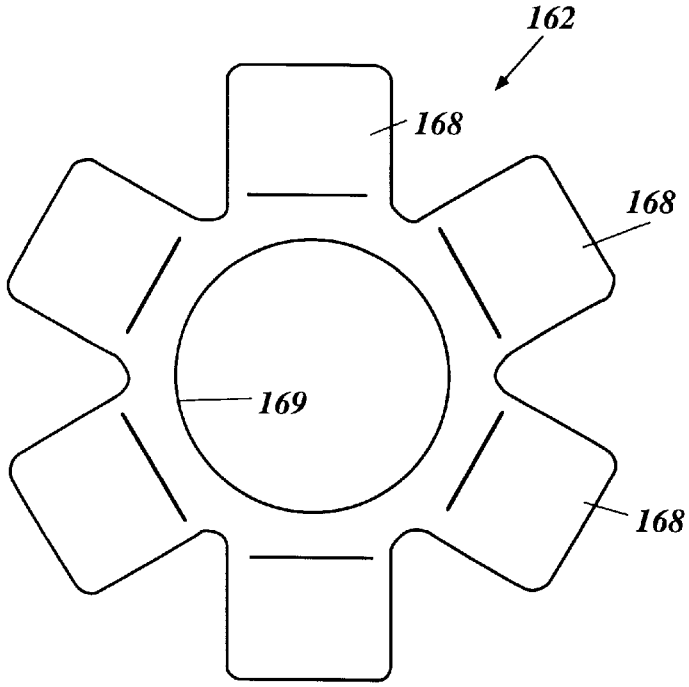
FIG. 6 is a front view of a Belleville spring.

In the illustrated arrangement, the propulsion shaft 92 is divided into two shaft sections. A transmission coupling 106 couples both of the shaft sections. With reference to FIGS. 4 to 6, the transmission coupling 106 will now be described.

With reference now to FIGS. 4 and 5, the propulsion shaft 92 preferably is divided into a forward shaft section 108 and a rear shaft section 110. The forward section 108 is coupled to the bevel gear transmission 96, while the rear section 110 is coupled to the propeller 94. One bevel gear 112, which is a forward drive gear, is shown in FIG. 4. The bevel gear 112 has a hub portion 113 that is journaled in a shaft housing 114 by an anti-friction ball bearing 116. The ball bearing 116 is contained in a portion of a forward end of the shaft housing 114 that defines a cavity 117.

The shaft housing 114 is suitably affixed within a horizontally extending bore formed in the lower unit 74. The forward shaft section 108 is journaled on the shaft housing 114 by a needle bearing 118 via the ball bearing 116 and the hub portion 113 of the bevel gear 112. Thus, the forward shaft section 108 is journaled within the hub portion 113 of the bevel gear 112. The shaft housing 114 also supports the rear shaft section 110 with a needle bearing 122. The forward shaft section 108 has an axially recessed portion at its rear end portion, while the rear shaft section 110 has a projection that generally fits the recessed portion. The projection of the rear shaft section 110 is fitted into the recessed portion of the forward section 108 via a metal bushing 124. In this regard, respective axes of the forward and rear shaft sections 108, 110 are aligned along a common axis. Seal members 126 are provided about the shaft 110 immediately rearward of the needle bearing 122 so as to inhibit water from freely entering the interior of the shaft housing 114.

The illustrated coupling assembly 106 is confined in the cavity 117 of the shaft housing 114. In order to close the cavity 117 and to confine the coupling assembly 106 therein, a bearing assembly 130 and a thrust bearing 132 are provided at forward and rear ends of the cavity 117 respectively. The bearing assembly 130 includes an outer holder 134, an inner holder 136 and a thrust bearing 138 interposed between both the outer and inner holders 134, 136. The outer holder 134 has a threaded outer surface, while the shaft housing 114 has a threaded inner surface. The outer holder 134 is affixed to the inner surface of the shaft housing 114 by screw connection. The inner holder 136, on the other hand, has a splined inner surface and is connected to the forward shaft section 108 that has an outer splined surface by spline connection. Because of this construction, the bearing assembly 130 can rotatably support the forward shaft section 108, although the bearing assembly 130 itself is fixed to the shaft housing 114. Of course, other arrangements can be used to attach the inner and outer holders 134, 136 to the housing 114 and the shaft assembly 108.

The transmission coupling 106 generally comprises a coupling assembly 140 and a spring assembly or damper 142. The spring assembly 142 is expandable and compressible axially along the common axis of the propulsion shaft 92 under an action of the coupling assembly 140.

The coupling assembly 140 includes a forward coupling member 144 and a rear coupling member 146. The forward coupling member 144 has a splined inner surface that is coupled to the outer splined surface of the forward shaft section 108. A forward portion 148 of the forward coupling member 144 forms a hub extension and has a reduced outer diameter to support a rear portion of the spring assembly 142. The forward coupling member 144, therefore, abuts a rear surface of the spring assembly 142 at its forward end and is slidably moveable on the forward shaft section 108.

With reference to FIG. 5, the forward coupling member 144 has a plurality of teeth 150 at its rear end. In the illustrated arrangement, the teeth 150 have trapezoidal configurations. The rear coupling member 146 also has a plurality of trapezoidal teeth 152 that mesh or interlock with the teeth 150 of the forward coupling member 146. Of course, the teeth can have any of a number of mating configurations. The rear coupling member 146 has a splined inner surface, while a forward end of the rear shaft section 110 has a splined outer surface. The rear coupling member 146 is coupled to the rear shaft section 110 by the spline connection, like the connection of the forward coupling member 144 and the forward shaft section 108.

In the illustrated arrangement, a spacer 154 is interposed between the rear coupling member 146 and the thrust bearing 132. The spacer 154 is provided not only for filling the space existing therebetween but also for receiving the reaction force that will be generated when the forward coupling member 144 is pushed forwardly. The reaction force is actually received by any number of C-shaped clips 156 that back up the spacer 154. The clips 156 preferably are received by a groove 158 that is formed around a portion of the rear shaft section 110. Part of a forward end of the spacer 154 has a splined inner surface that couples with the splined outer surface of the rear shaft section 110. In some arrangements, the spacer 154 can be unified with the rear coupling member 146.

The illustrated coupling assembly 140 defines a dog clutch that has the trapezoidal tooth 150, 152 engaged together. In addition, the rear coupling member 146 is precluded from substantial rearward movement by the spacer 154. The coupling assembly 140 and the damper 142 are disposed between the spacer 154 and the bearing assembly 130. Thus, the forward coupling member 144 can move forward along the common axis of the propulsion shaft 92 when the forward shaft section 108 begins to drive the rear shaft section 110. Because the rear shaft section 110 does not rotate immediately due to its inertia, which arises from the rotational resistance of the propeller 94 in the body of water, almost the entire force or torque being transmitted to the rear shaft section 110 is converted to an axial force that pushes the forward coupling member 144 forwardly toward the spring assembly 142 (hereunder referred to as "forward force component").

The forward force component is generated by the trapezoidal configurations of the teeth 150, 152. However, the teeth 150, 152 can have other configurations that convert a torque of the forward shaft section 108 to an axial that will move the forward coupling member 144 toward the damper 142. For instance, the teeth 150, 152 can generally include oblique surfaces or triangle configurations. Rectangular configurations, however, are not generally preferred because they do not have oblique surfaces that can convert the torque to the forward force component.

The forward force component also can be generated when a rotational speed of the rear shaft section 110 lags behind that of the forward shaft section 108. Normally, the forward and rear shaft sections 108, 110 rotate at the same speed. Such an asynchronous condition generally arises when the forward shaft section 108 begins to rotate the rear shaft section 110 as described above. The forward end 148 of the forward coupling member 144 abuts the spring assembly 142 to limit or restrict its forward axial movement. The forward coupling member 144, therefore, moves forward when the torque is greater than a preset magnitude that can overcome the expansion force of the spring assembly 142.

In the illustrated arrangement, the spring assembly 142 includes four Belleville springs 162. The respective Belleville springs 162 preferably as positioned to warp alternately. That is, a first spring 162*a* and a second spring 162*b* face each other, while a third spring 162*d* and a fourth spring 162*c* face each other. As seen in FIG. 4, five flat washers 164 preferably are inserted between the respective springs 162. A spring housing 166 preferably encases the springs 162 and washers, 164 as a unit. Because of this arrangement, the respective Belleville springs 162 fully expand along the common axis of the forward and rear shaft sections 108, 110 of the propulsion shaft 92 in a relaxed state until a compressive force is applied.

As seen in FIG. 6, the respective Belleville springs 162 in this arrangement preferably have six projections 168 extending radially like petals. A through-hole 169 is formed in the center. The petal configuration is advantageous because a mere alteration in number of the projections 168 can change a spring constant of the Belleville spring 162. Of course, other configurations of the Belleville springs 162 can be used, such as disk or plate shapes. Generally, the spring constant is adjustable by, for example, increasing or decreasing the number of Belleville springs themselves or by changing the number of projections 168.

When the operator starts the engine 78 and shifts the bevel gear transmission 96 to a forward or reverse position by operating the shift mechanism 98, the output shaft 88 of the engine 78 begins to power the propeller 94 through the driveshaft 90, the bevel gear transmission 96 and the propulsion shaft 92. Thus, the propulsion shaft 92 and the forward shaft section 108 begin to rotate the rear shaft section 110 through the coupling assembly 140. However, the rear shaft section 110 does not rotate at the very moment of this starting process as noted above. The transmission coupling 106 absorbs the shift shock as follows.

Generally the force of the torque, if it is larger than a predetermined magnitude that overcomes the expansion force of the spring assembly 142, makes the rear coupling member 146 push the forward coupling member 144 toward the spring assembly 142. That is, the shift shock is converted into a forward force that moves the forward coupling member 144. This movement of the forward coupling member 144 compresses the Belleville springs 162 against the bearing assembly 130 to a certain degree until the energy of the forward coupling member 144 is exhausted. While the rear coupling member 146 moves forward, the rear shaft section 110 generally remains axially stationary.

Next, the spring assembly 142 returns the forward coupling member 144 toward the rear coupling member 146 by the expansion force of the Belleville springs 162 when the forward member 144 and the rear member 146 approach the same rotational velocity. The teeth 150 of the forward coupling member 144 increasingly engage with the teeth 152 of the rear coupling members 146. After full engagement has been achieved, the forward shaft section 108 securely drives the rear shaft section 110 through the coupling assembly 140 that is coupled to both the shaft sections 108, 110 by the spline connection.

As described above, in the illustrated arrangement, the power transmission system 52 has the transmission coupling 106 that can effectively absorb the shift shock. Also, the transmission coupling 106 comprises the coupling assembly 140 and spring assembly 142, both of which are relatively small and can be neatly accommodated within the shaft housing 114. In other words, the transmission coupling 106 is compact and can be easily placed within the lower unit 74. In addition, after the return of the forward coupling member 144 to the rear coupling member 146, both sets of teeth 150, 152 securely engage each other. The forward coupling member 144, therefore, can sufficiently transmit driving force to the rear coupling member 146. Thus, the propulsion shaft 92 rotates as if it is a single shaft.

Figure 7:
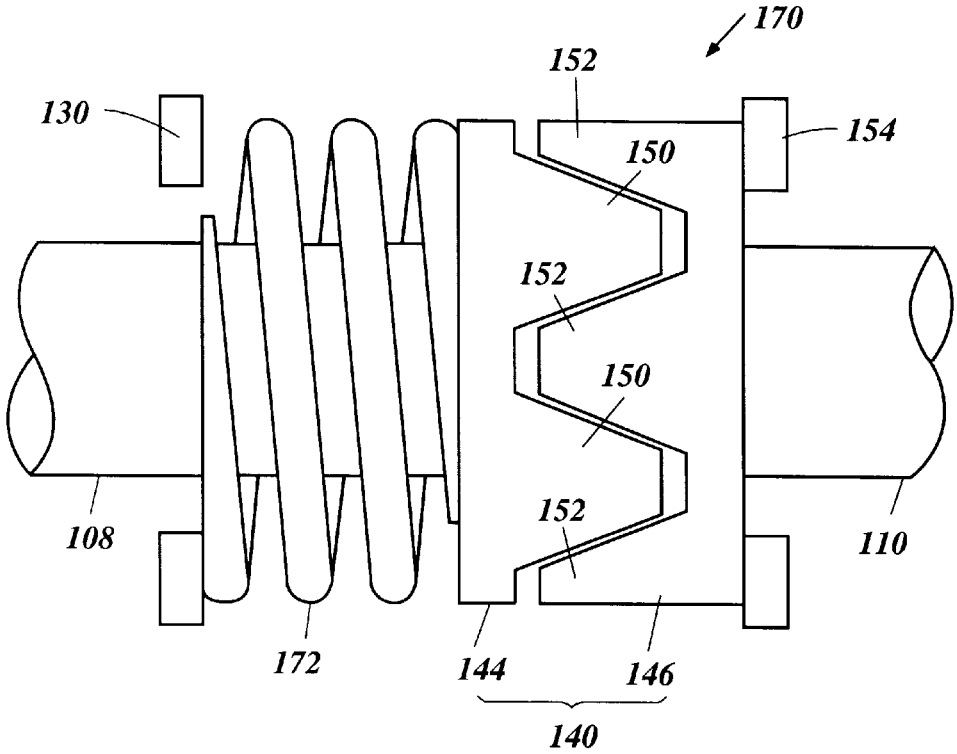
FIG. 7 is a side view of another transmission coupling configured in accordance with certain aspects, features and advantages of the present invention.

It should be noted that various types of damper structures can be used. For instance, FIG. 7 illustrates a transmission coupling 170 configured in accordance with certain features, aspects and advantages of the present invention. In this transmission coupling 170, a single coil spring 172 replaces the spring assembly 142 and acts as a damper. The other components can be the same as those shown in FIGS. 4 and 5 and described above. FIG. 7 also shows the trapezoidal configurations of the teeth 150, 152. The bearing assembly 130 and the spacer 154 are schematically illustrated in this figure.

Also, the damper can be mounted on an inner surface of the shaft housing 114 instead of being mounted on the propulsion shaft 92 if the damper is placed in the locus of the moveable coupling member 144. Moreover, the damper can be positioned adjacent the rear shaft section 110. Of course, the moveable coupling member, in this arrangement, would be positioned adjacent the rear shaft section 110. As described above, the shock absorbing efficiency can be adjusted by, for example,, changing the spring constant of the damper or the angles of the trapezoidal configurations of the teeth.

The surfaces of the teeth can be formed in other configurations that include interacting faces that slope sufficient that tortional powder can be redirected into axial force. For example, if the bevel gear transmission only has the forward position other than the neutral position, teeth can be configured in any configurations, including rectangular shapes, on one side. Normally, however, the transmission has the forward, neutral and reverse positions; thus, the surfaces of the teeth preferably are configured generally symmetrically. Of course, the two sides can be arranged to have differing shock absorbing characteristics for forward and reverse operation.

Generally, the transmission coupling can be placed at any position in the power transmission system 52. For instance, a portion of the driveshaft 90 and an interconnecting portion of the driveshaft 90 that is coupled to the output shaft 88 can be connected in this manner. FIG. 3 shows two other exemplary positions 174, 176. The position 174 is located along driveshaft 90, while the position 176 is located at the coupling between the driveshaft 90 and the output shaft 88.

Figure 8:
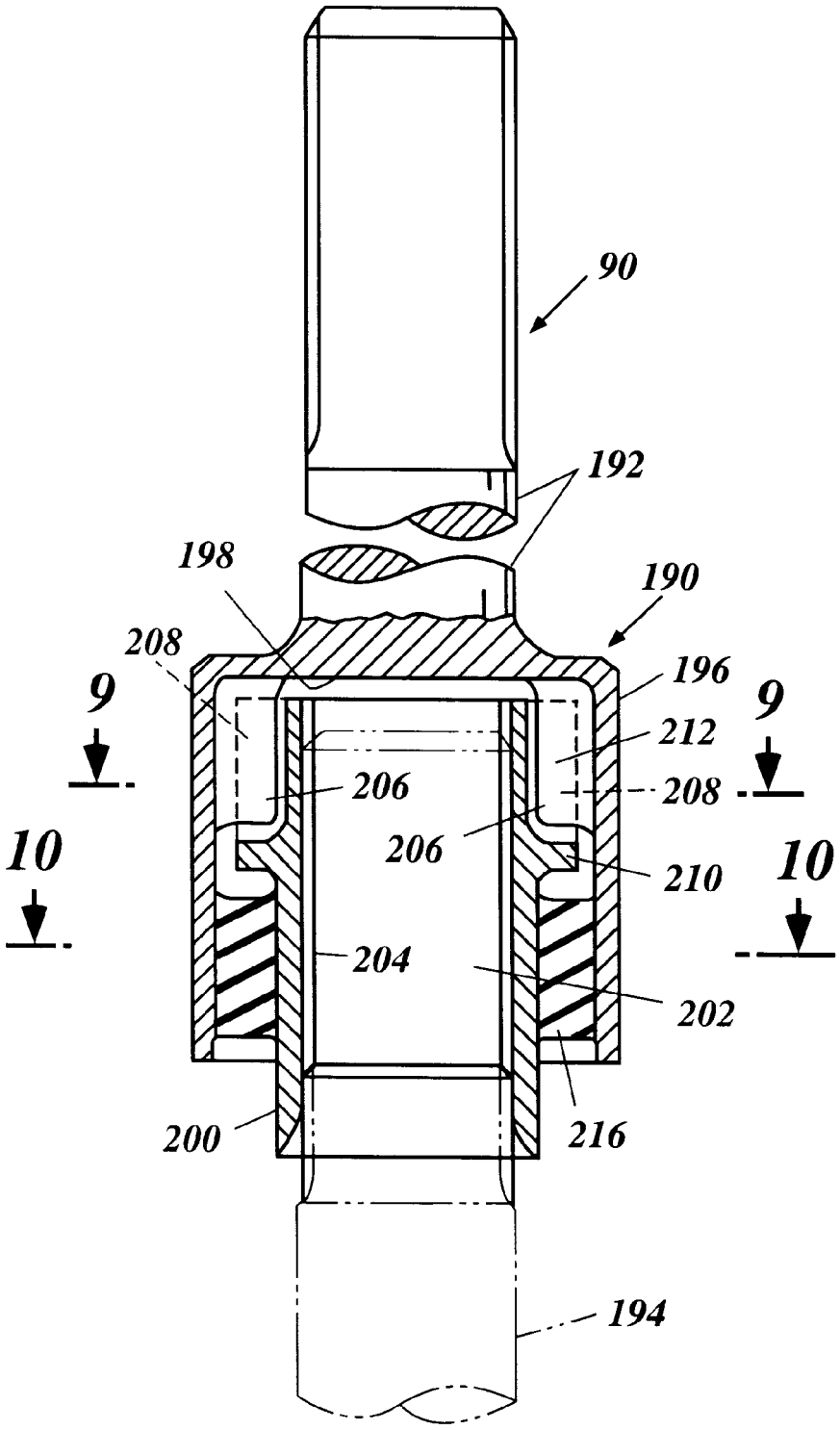
FIG. 8 is a cross-sectional, side elevational view of a further transmission coupling configured in accordance with certain aspects, features and advantages of the present invention.
Figure 9:
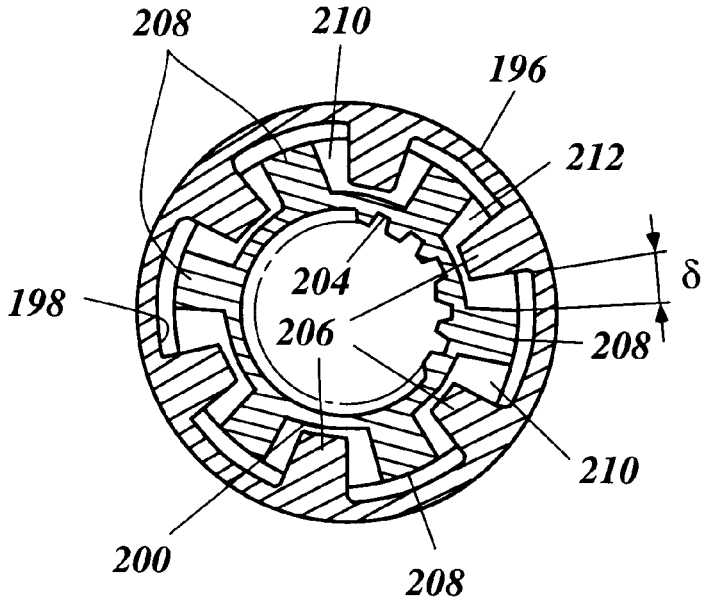
FIG. 9 is a cross-sectional view showing the coupling of FIG. 8 taken along the line 9—9.
Figure 10:
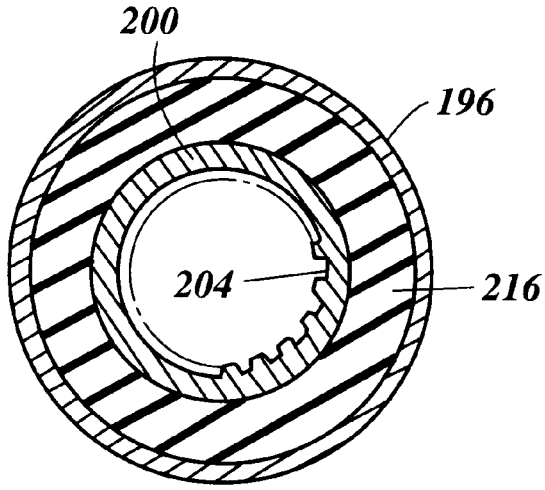
FIG. 10 is a cross-sectional view showing the coupling of FIG. 8 taken along the line 10—10.

As described above, the foregoing transmission couplings 106, 170 have structures in which a coupling assembly and a damper are disposed next to each other and one portion of the coupling assembly is moveable toward the damper so as to compress it. Others also have been contemplated. For example, both shaft sections can be coupled with each other through a pair of coupling connections: one of the coupling connections includes an elastic member or material that is permanently connected to both of the shaft sections while the other coupling connection includes rigidly engageable members such as teeth of a dog clutch. With reference to FIGS. 8 to 10, such an arrangement will be described. This transmission coupling 190 preferably is placed at the position 174 of FIG. 3. The same components and members that have been described above will be assigned with the same reference numerals and will not be described repeatedly unless specific descriptions are necessary.

The driveshaft 90 is divided into a drive section 192 and a driven section 194. The transmission coupling 190 includes a damper coupling construction that couples the respective sections 192, 194. The lower end of the drive section 192 is provided with an outer coupling portion or depending flange 196 that defines an internal cavity 198. As seen in FIGS. 9 and 10, the outer coupling member 196 and the cavity 198 preferably have circular constructions. An inner coupling member 200, which also has a circular shape, is inserted into the internal cavity 198. An upper portion 202 of the driven section 194 is inserted into the inner coupling member 200. In the illustrated construction, the inner coupling member 200 and the upper portion 202 of the driven section 194 are coupled with each other by a spline connection 204. Of course, other connection techniques also can be used.

In the upper half of the cavity 198 of the outer coupling member 196, six teeth 206, which have generally rectangular configurations, extend generally inwardly toward the center of the cavity 198. The teeth 206 are arranged to be side by side every 60 degrees in the illustrated arrangement. In the upper half portion of the inner coupling member 200, six teeth 208, which also have generally rectangular configurations, extend generally radially outward from an outer surface of the inner coupling member 200. As best seen in FIG. 8, in the illustrated construction, a flange portion 210 extends outwardly from the outer surface of the inner coupling member 200. Additionally, the teeth 208 extend upwardly from the flange portion 210. As seen in FIG. 9, the respective teeth 206, 208 are disposed alternately so as to engage with each other. Thus, both the upper portions of the outer and inner coupling members 196, 200 are coupled together by a dog clutch connection 212.

In a lower half of cavity 198, an elastic or resilient member 216, which has generally a circular shape, is provided to couple respective lower halves of the outer and inner coupling members 196, 200 with each other. The elastic member 216 is made of, for example, rubber material. In the illustrated construction, the elastic member 216 is rigidly affixed to the outer and inner coupling members 196, 200. That is, the elastic member 216 is formed by a baking process between the inner surface of the outer coupling member 196 and the outer surface of the inner coupling member 200. The coupling by this elastic member 216, thus, provides a lost motion connection therebetween.

The driveshaft 90 featuring the transmission coupling 190 can be made through the following method. The inner cavity 198 is first formed in the outer coupling member 120. Both the outer and inner coupling members 196, 200 are formed with the teeth 206, 208 of the dog clutch arrangement. The inner coupling member 200 is inserted into the cavity 198 of the outer coupling member 196. These members 196, 200 are positioned relative to each other such that a fixed space δ (see FIG. 9) is defined between the respective adjacent teeth 206, 208. Under this condition, rubber material, which will be the elastic member 216, is inlaid between the inner surface of the outer coupling member 196 and the outer surface of the inner coupling member 200. Then, the rubber material is heated or baked. Eventually, both the inner and outer coupling members 196, 200 are firmly fixed with each other by the elastic member 216. Under this condition, the respective teeth 206, 208 of the dog clutch 212 are disposed side by side alternately with the fixed spaces δ. The driveshaft 90 is then completed by coupling the upper portion 202 of the driven section 194 with the inner coupling member 200 via the splined connection.

The outer coupling member 196 is unified with the drive section 192 in this illustrated construction; however, it can be separately formed and then coupled together with the drive section 192 by, for example, a spline connection like that described above. The inner coupling member 200 also can be unified with the driven section 194. Conversely, the outer coupling member 196 and drive section 192 can be separately made.

By coupling the driven section 194 with the inner coupling member 200, an axis of the drive section 192 coincides with an axis of the driven section 194. These axes define an aligned common axis of the driveshaft 90. As described above, the dog clutch 212 exists in the upper half portion of the transmission coupling 192 and the elastic member 216 exists in the lower half portion thereof. That is, the dog clutch 212 and the elastic member 216 are spaced apart from each other in an axial direction. Of course, these relative positions are interchangeable. The dog clutch 212, in other words, can be positioned below the elastic member 216. Also, a single dog clutch 212 can be interposed between a pair of elastic members. Furthermore, the arrangement of the transmission coupling 190 illustrated in FIGS. 8 and 9 can be completely reversed. In this alternative arrangement, the drive section 192 would be provided with the inner coupling member 200, while the driven section 194 is provided with the outer coupling member 196 that includes the inner cavity 198.

With continued reference to FIGS. 8 to 10, when the operator wants to move the watercraft 60, he or she operates the throttle valve mechanism so that the engine 78 can increase its engine speed. The operator then continuously operates the throttle valve mechanism until the watercraft 60 moves at a speed he or she desires.

As described above, the output shaft 88 of the engine 78 drives the drive section 192 of the driveshaft 90. The driving force of the drive section 192 is first transferred to the driven section 194 through the elastic member 216 by its shearing stress. That is, the elastic member 216 provides a lost motion of the driven section 194 because of its resilience. The elastic member 216 provides the power transmission under a low speed and low load condition. However, when the driving load increase, the lost motion reaches a predetermined level and then the respective teeth 206, 208 of the dog clutch 212 begin to engage with each other. The torque of the drive section 192 is hence transferred to the driven section 194 through the dog clutch 212 from this moment. More specifically, with an increase in the driving load, the elastic member 216 is compressed and the spaces δ between the respective teeth 206, 208 become narrower until the sets of teeth 206, 208 contact each other. At this moment, the coupling with the elastic member 216 is overridden by the coupling with the dog clutch 212, and the driving force of the drive section 192 is mainly transferred through the dog clutch 212.

Generally, the driving load increases when the propeller 94 begins to rotate in the body of water. When the propeller 94 first begins to rotate, the driving load is at a maximum and then the load decreases gradually if the rotational speed is fixed. However, in many instances, the speed continuously increases under the starting condition. When the speed increases, the driving load also increases. This is because that water has viscosity that resists movement of the propeller 94. The lost motion device absorbs this resistance caused when the driven section 194 cannot immediately follow the rotation of the drive section 192.

The power from the engine 78 thus is transmitted to the driven section 194 through the drive section 192 and then the transmission coupling 190. If, however, the shift mechanism 98 is set at the neutral position, the power will not be transferred to the propulsion shaft 92. The propeller 94 does not rotate and hence the associated watercraft 60 is not propelled. Under this condition, as readily understood, the driving load does not exist. Therefore, the drive section 192 and the driven section 194 are coupled together only through the elastic member 216 even though the engine speed is very high.

Figure 11:
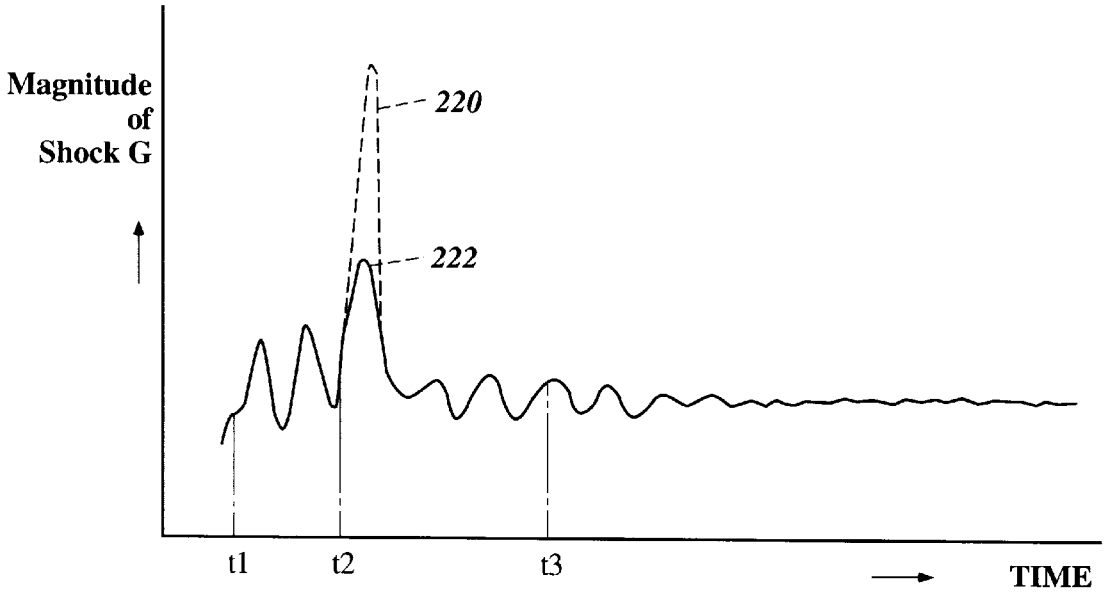
FIG. 11 is a graphical illustration of a magnitude of shock (acceleration) G versus time.

If the bevel gear transmission 96 is shifted by the shift mechanism 98 to, for example, the forward position, the driving load is abruptly exerted. Thus, when the bevel gear transmission 96 first is shifted into the forward position, a large shock or load is produced. FIG. 11 illustrates such a situation. The vertical axis of the graph indicates magnitude of shock (acceleration) G that is proportional to the rate of change of propulsion force or loads. The magnitude of shock changes over time which is indicated by the horizontal axis.

With reference to FIG. 11, the operator starts shifting the bevel gear transmission 96 with the shift mechanism 98 at a time t1. At this moment, although the shift rod 100 begins to move, no engagement occurs. With a small time lag and at a time t2, however, the transmission 96 falls into the forward drive position. If the elastic member 216 were not involved in the drive train, a huge shock would be produced as illustrated with the dotted line indicated by the reference numeral 220. This shock 220 would be transmitted to the watercraft 60 and jolt the occupants. Because the elastic member 216 allows lost motion in the drive train, the shock 220 is absorbed quite effectively by deflection of the elastic member 216. The magnitude of the shock is, therefore, reduced as shown in the solid line 222 of FIG. 11. Energy of the shock absorbed by the elastic member 216 is changed to heat energy and dissipated.

Figure 12:
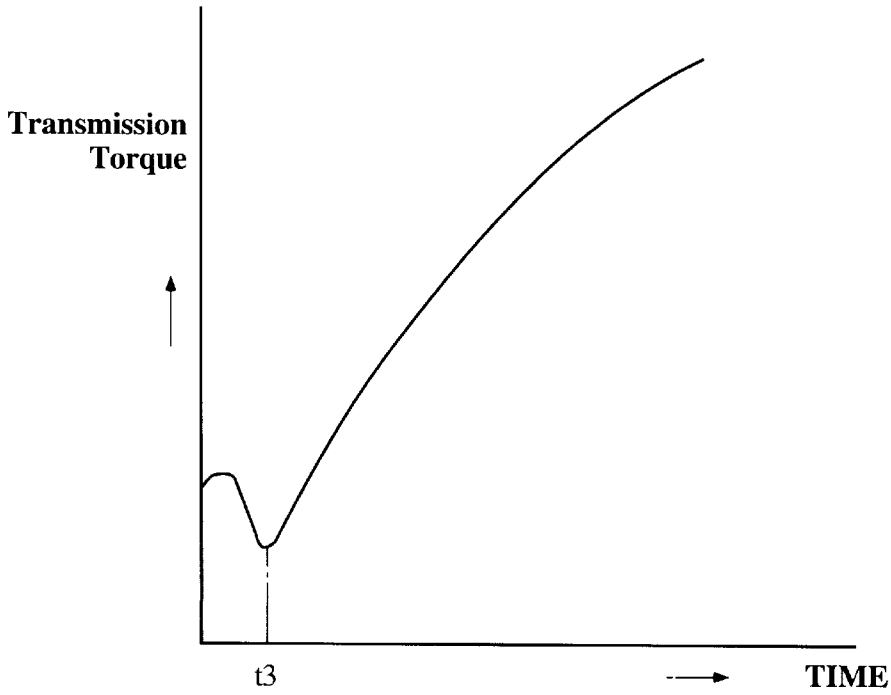
FIG. 12 is a graphical illustration of a transmission torque versus time.

At a time t3, the respective teeth 206, 208 of the dog clutch 212 engage with each other because the driving load increases. Before the respective teeth 206, 208 engage with each other, the elastic member 216 couples the drive and driven sections 192, 194 as noted above. At this point, the transmission torque from the drive section 192 to the driven section 194 slightly decreases and then subsequently increases after the time t3. This situation is illustrated in FIG. 12. In this figure, the vertical axis indicates the transmission torque that changes over time as indicated by the horizontal axis.

Because the power of the engine 78 is transmitted to the driven section 194 from the drive section 192 through deflection of the elastic member 194 before the time t3, the transmission torque decreases. However, when the deflection amount reaches the size of the space δ (see FIG. 9), the teeth 206, 208 engage with each other and the power is transmitted only through the dog clutch 212. This time corresponds to the time at which the lost motion of the elastic member 216 reaches the predetermined level. All members of this dog clutch 212 are rigid. Thus, after the time t3, the drive section 192 and the driven section 194 are rigidly coupled with each other. With increased of the engine speed after the timing t3, the transmission torque increases as seen in FIG. 12.

The magnitude of the shock generally fluctuates as shown in FIG. 11. The fluctuation occurs because the driving torque of the engine 78 fluctuates. This torque fluctuation appears relatively large when the engine speed is small; however, the fluctuation is also damped by the elastic member 216 in the illustrated construction and then substantially disappears with engine speed increases.

Because the dog clutch 212 and the elastic member 216 in the illustrated construction are separately disposed in the direction along the common axis of the driveshaft 90, the diameter of the elastic member 216 can be reduced. The rigid fixing of the elastic member 216 by the baking process also helps to reduce this diameter. Additionally, a rigid coupling such as a dog clutch 212 can be employed in this arrangement. Accordingly, the elastic member 216 can quite effectively absorb the shift shock even though it has such a small diameter. Providing such a compact coupling structure between the two sections 192, 194 of the driveshaft 90 is very advantageous. Also, after the driving load reaches a predetermined level, the power from the engine 78 is transmitted directly through the dog clutch 212.

The transmission coupling 190 in the illustrated construction is positioned directly above the water pump 91. Because portions around the water pump 91 can act as a heat sink, the transmission coupling 190 can be well cooled in this arrangement. This cooling effect contributes to an extension of the life of the elastic member 216. Incidentally, if the transmission coupling is disposed at the foregoing position 176, the coupling also can be well lubricated because a lubrication system is normally placed proximate the position 176.

Figure 13:
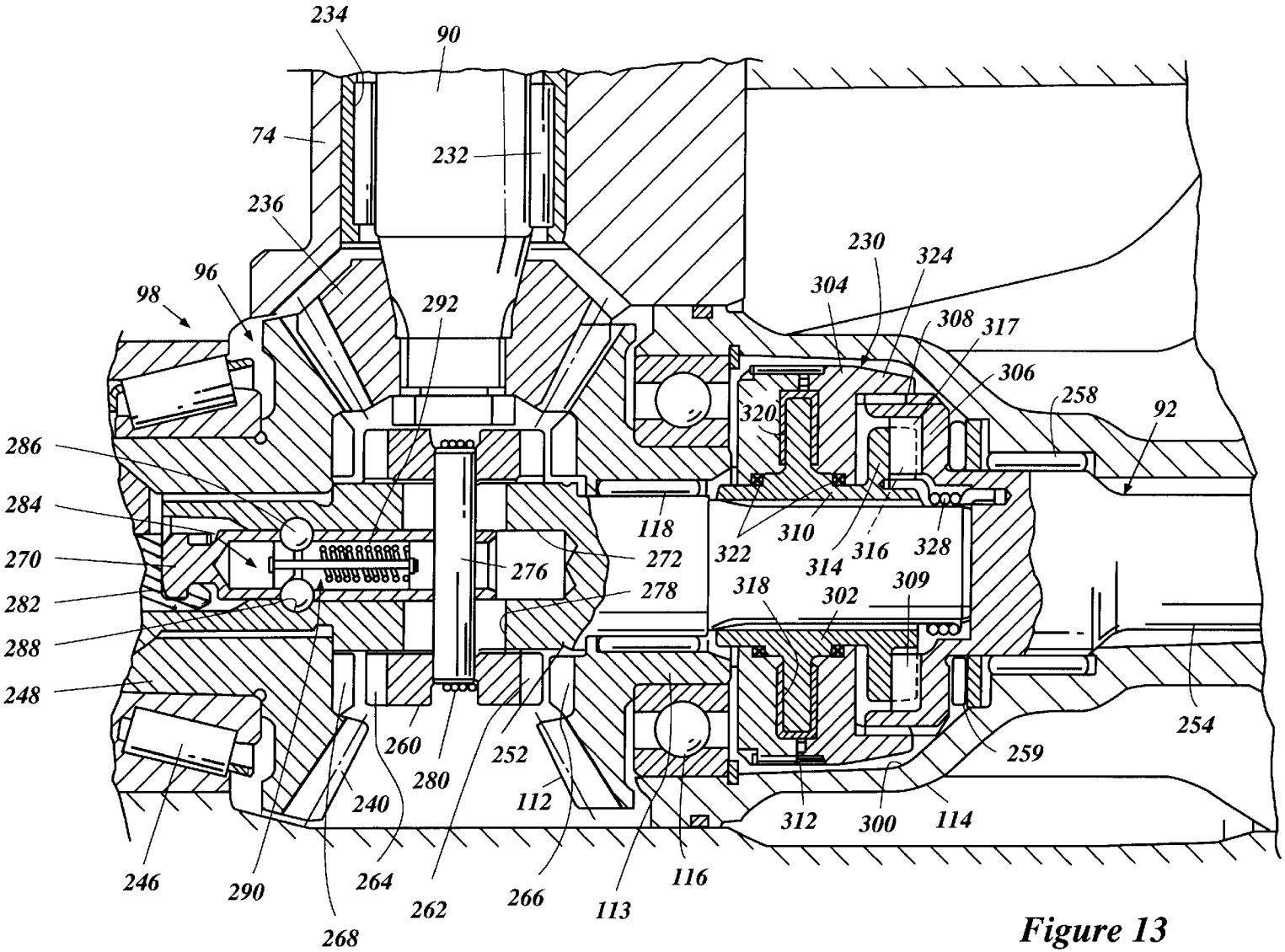
FIG. 13 is a cross-sectional, side elevational view of a shift and transmission mechanism including another coupling arrangement configured in accordance with certain aspects, features and advantages of the present invention.

With reference now to FIG. 13, another :transmission coupling 230 having certain features, aspects and advantages in accordance with the present invention will be described. The transmission coupling 230 preferably is disposed along the propulsion shaft 92. The same components and members that have been already described will be assigned with the same reference numerals and will not be described repeatedly unless necessary for completeness.

The driveshaft 90 is journaled by a needle bearing 232 in a vertically extending axial opening 234. A drive bevel gear or pinion 236 is affixed to a lower end of the driveshaft 92. The drive bevel gear 236 meshes with a pair of diametrically opposed driven bevel gears, which are the foregoing forward drive gear 112 and a reverse drive gear 240, respectively. As described above, the forward drive gear 112 has a hub portion 113 that is journaled by the ball bearing 116. The reverse drive gear 240 is journaled by a thrust bearing 246 that engages a hub portion 248 and that is disposed within the housing of the lower unit 74.

The propulsion shaft 92 comprises a drive section or forward shaft section 252 and a driven section or rear shaft section 254 both are coupled together by the transmission coupling 230. A forward portion of the drive section 252 is received in the hub 248 of the reverse drive gear 240, while a rear portion thereof is received in the hub 113 of the forward drive gear 112 with the needle bearing 118. The driven section 254 is received in the shaft housing 114 with a needle bearing 258 and a thrust bearing 259.

A sleeve 260 is slidably journaled on the drive section 252 by a spline connection so as to be positioned between both the bevel gears 112, 240. The sleeve 260 has a pair of groups of teeth 262, 264 which are configured as rectangular shapes and extend oppositely from each other along an axis of the propulsion shaft 92. The bevel gears 112, 248 also have teeth 266, 268 which are also configured as rectangular shapes and face the respective teeth 262, 264. One group of teeth 262 of the sleeve 260 and the teeth 266 of the forward drive gear 112 define a forward dog clutch, while the other group of teeth 264 of the sleeve 260 and the teeth 268 of the reverse drive gear 240 define a reverse dog clutch.

If the sleeve 260 slides rearwardly along the axis of the propulsion shaft 92, in a manner to be described, the teeth 262 of the sleeve 260 engage with the teeth 266 of the forward drive gear 112. The forward drive gear 112, therefore, will be rotatably coupled to the drive section 252 of the propulsion shaft 92. The propeller 94 is driven in the forward drive direction accordingly. If the sleeve 260 slides forwardly, the teeth 264 of the sleeve 260 engage with the teeth 268 of the reverse drive gear 240. The reverse drive gear 240 will be again rotatably coupled to the drive section 252 of the propulsion shaft 92. Because, however, the reverse drive gear 240 rotates in the opposite direction relative to the forward drive gear 112, the propeller 94 rotates in the reverse drive direction. If the sleeve 260 does not slide rearwardly or forwardly, the teeth 262, 264 of the sleeve 260 will not engage with the teeth 266, 268 of the respective gears 112, 240. The propulsion shaft 92, thus, will not rotate. This is the neutral condition.

In order to shift the sleeve 260 rearwardly or forwardly, a shift plunger 270 is slidably supported within a bore 272 formed in the forward portion and partially in the rear portion of the drive section 252. A shift pin 276 couples the shift plunger 270 to the sleeve 260, while, at the same time, insures the sleeve 260 rotates with the drive section 262 of the propulsion shaft 92. There is provided an elongated slot 278 in the drive section 252 to permit an axial movement of the pin 276 in addition to the coupling construction. A spring 280 encircles a groove formed in the sleeve 260 so as to hold the pin 276 in position. The shift plunger 270 is coupled to a shift actuating member 282 that is moveable by the shift rod 100. The shift rod 100 reciprocates the shift actuating member 282.

In order to hold the shift mechanism 98 in the neutral position, a detent mechanism 284 that comprises a plurality of detent balls 286 is contained within the shift plunger 270. The detent balls 286 are normally urged into engagement with detent recesses 288 of the drive section 252 by a spring loaded mechanism 290 including a spring 292. As a result, there will be snap action of the sleeve 260 toward the forward or reverse drive position when either one of the shift operations is given. This snap action brings a quick engagement between the sleeve 260 and the corresponding gear 112, 240.

With continued reference to FIG. 13, the transmission coupling 230 will now be described in detail. The transmission coupling 230 in the illustrated construction is disposed in an internal cavity 300 defined by the shaft housing 114. The transmission coupling 230 includes a first coupling member 302, a second coupling member 304 and a coupling portion 306. The coupling portion 306 is formed at the forward end of the driven section 254 and has a cup-like configuration that forms an inner connecting section 308 extending forwardly. The inner connecting section 308 is cylindrically formed and has a splined surface on the outside. The coupling portion 306 farther has a plurality of teeth 309 extending forwardly within the cup-like configuration and formed as rectangular shapes.

The first coupling member 302 has a hub portion 310 that is coupled with the drive section 252 of the propulsion shaft 92 by a spline connection, a circular flange 312 extending radially from the hub portion 310, and a clutch portion 314 extending also radially from the hub portion 310. The clutch portion 314 is disposed at the rear of the circular flange 312 so as to be positioned generally within the cup-like configuration of the coupling portion 306. The clutch portion 314 has plurality teeth 316 extending rearwardly and formed as rectangular shapes. The teeth 316 of the clutch portion 314 engage with the teeth 309 of the coupling portion 306. Thus, the two sets of teeth 309, 316 define a dog clutch 317.

The second coupling member 304 comprises two pieces that are mated at an outer surface of the circular flange 312 to form a recess 318 for enclosing the flange 312 therein with a small space or gap 320. The space 320 is filled with viscosity holding material such as, for example, oil or liquid synthetic resin that has relatively high viscosity. The space 320 is sealed with seal members 322 so that the viscous material will not leak from the space 320 to a large degree. The second coupling members 304 also includes an outer connecting section 324 which is cylindrically formed and extends rearwardly. The outer connecting section 324 has a splined surface on the inside. The splined surface of the outer connecting section 324 is coupled with the splined surface of the inner connecting section 306 to join the second coupling member 304 and the coupling portion 306 of the driven section 254 in rotation.

A spring 328 is provided between the first coupling member 230 and the coupling portion 306 of the driven section 254 to hold the teeth 309, 316 disengaged from each other under the static (non-rotational) condition of the propulsion shaft 92. The internal cavity 300 is filled with lubricant. The spline connections, dog clutch 317 and torsion spring 328, thus, are well lubricated at all times.

In this illustrated construction, the circular flange 312 of the first coupling member 302, the recess 318 of the second coupling member 304, the space 320 and the viscosity holding material filling the space 320 define a first coupling mechanism. Meanwhile, the dog clutch 317, which is formed with the teeth 316 of the first coupling member 302 and the teeth 309 of the coupling portion 306, define a second coupling mechanism. The first and second coupling mechanisms are, thus, spaced apart, from each other in a direction of the common axis of the drive and driven sections 252, 254 that is the axis of the propulsion shaft 92.

If the sleeve 260 is placed in the neutral position as shown in FIG. 13, both the forward and reverse gears 112, 240 are idle and no power is transmitted to the propulsion shaft 92 from the driveshaft 90. Thus, the propulsion shaft 92 does not rotate and the watercraft 60 does not move under power of the engine. If the sleeve 260 is shifted to, for example, the forward drive position, the teeth 262 of the sleeve 260 engage with the teeth 266 of the forward drive gear 112 and the power is transmitted to the drive section 252 of the propulsion shaft 92 through the bevel gear 236, forward drive gear 112, sleeve 260 and shift pin 276.

In this initial state, the drive section 252 is first connected to the driven section 254 by the first coupling mechanism including the viscosity holding material. This first coupling mechanism provides a lost motion of the driven section 254 because of the viscosity holding material. Therefore, the large load of the propeller 94, i.e., a shift shock, which is abruptly generated with the driven section 254, is effectively absorbed by the lost motion device and is not transmitted to the associated watercraft 60. The occupants in the watercraft 60, thus, do not experience a shock or jerk in the watercraft.

With increases of the engine speed, the drive section 252 rotates more rapidly and the lost motion increases. When the lost motion reaches a predetermined level, the respective teeth 309, 316 of the dog clutch 317 engage with each other against the biasing force of the torsion spring 328. The dog clutch 317, i.e., second coupling mechanism solely couples the drive section 252 to the driven section 254. That is, second coupling mechanism overrides the first coupling mechanism. Since the dog clutch 317 as the second coupling mechanism is a rigid connection, the lost lotion will no longer occur and the power from the driveshaft 90 is securely transmitted to the propulsion shaft 92. The propeller 94, thus, rotates to propel the watercraft 60 forwardly. If the sleeve 260 is shifted to the reverse drive position, the reverse drive gear 240 is selected and similar actions will occur to propel the watercraft 60 rearwardly.

In this construction, the viscosity holding material is used instead of the elastic member 216 that is used in the foregoing construction. It is advantageous because a coefficient of viscosity can be easily selected. This means that resilience of the first coupling mechanism is also easily selected because the resilience is proportional to the coefficient of viscosity. Also, oil or liquid synthetic resin employed as the viscosity holding material in this construction can be enclosed in a relatively narrow space like the space 320. Because they do not need a large volume for enhancing the resilience even though they requires a relatively large surface area. The transmission coupling 230, thus, can have a compact structure so as to be disposed in the small cavity 300 defined in the shaft housing 114. Moreover, the torsion spring 328 also serves to provide some degree of lost motion between the first coupling member 302 and the second coupling member 304.

Thus, the constructions described in reference to. FIGS. 8–13 illustrate two additional damping couplers that can be used to transfer low level torque while damping coupling shock when the transmission is shifted. It should be noted that the transmission couplings 106, 170 shown in FIGS. 3–7 and the transmission coupling 230 shown in FIG. 13 have generally the same change in the magnitude of shock as shown in FIG. 11. Also, the transmission coupling 230 has generally the same change in the transmission torque as shown in FIG. 12.

Although the present invention has been described in terms of certain preferred arrangements, other arrangements apparent to those of ordinary skill in the art also are within the scope of this invention. Various changes and modifications can be made without departing from the spirit and scope of this invention. Accordingly, the scope of the present invention is intended to be defined only by the claims that follow and any reasonable equivalents of the claims.

What is claimed is:

1. A power transmission system for a marine propulsion unit having a powering element and a propulsion device, the system comprising a first shaft driven by the powering element, a second shaft driven by the first shaft and driving the propulsion device, the first and second shafts extending in series with each other and having a common rotational axis, a first coupling member mounted on the first shaft, a second coupling member mounted on the second shaft, both the first and second coupling members coupling the first and second shafts together for rotation, and a damper mounted on the first shaft next to the first coupling member, the first coupling member being axially moveable along the common axis relative to the second coupling member in a direction toward the damper in response to rotational movement of the first shaft relative to the second shaft, the first and second coupling members generally fully engaging with each other under a first condition that the second shaft is capable to follow the rotation of the first shaft, and the first and second coupling members less engaging with each other than the first condition under a second condition that the second coupling member is left behind the rotation of the first shaft, wherein the first coupling member includes at least a first projection projecting from the first member toward the second member, the projection including at least first and second lateral sides, both sides being arranged to contact the second coupling member when the first and second coupling members are generally fully engaged with each other.

2. The power transmission system as set forth in claim 1, wherein the first projection comprises a plurality of teeth and the second coupling member include teeth engageable with the teeth of the first projection, the teeth having sliding surfaces that convert a torque of the first shaft to an axial force to push the first coupling member toward the damper.

3. The power transmission system as set forth in claim 2, wherein the sliding surfaces are oblique relative to the common axis.

4. The power transmission system as set forth in claim 3, wherein the teeth have trapezoidal configurations.

5. The power transmission system as set forth in claim 1, wherein the second coupling member is precluded from moving toward the opposite side of the damper.

6. The power transmission system as set forth in claim 1, wherein the damper includes at least one Belleville spring.

7. The power transmission system as set forth in claim 6, wherein the damper includes a plurality of Belleville springs stacked axially along the common axis.

8. The power transmission system as set forth in claim 6, wherein the Belleville spring has a petal configuration.

9. The power transmission system as set forth in claim 1, wherein the damper includes a coil spring.

10. The power transmission system as set forth in claim 1, wherein the damper is precluded from moving toward the opposite side of the first coupling member.

11. The power transmission system as set forth in claim 1, wherein the first and second shafts define a propulsion shaft on which the propulsion device is mounted.

12. A coupling for a power transmission having a drive shaft and a driven shaft extending in series with each other, the coupling comprising a first member rotatable together with one of the drive shaft and the driven shaft and having at least one tooth extending in an axial direction, a second member rotatable together with the other shaft and having at least one tooth extending in the axial direction to engage with the tooth of the first member, the tooth of the first member and the tooth of the second member being placed in a generally fully meshing position with each other when the drive shaft ceases driving the driven shaft, and a damper disposed next to the first member, the first member moving in the axial direction opposite to the second member to compress the damper and the tooth of the first member being placed out of the generally fully meshing position with the tooth of the second member when the drive shaft begins to drive the driven shaft.

13. The coupling as set forth in claim 12, wherein the first member compresses the damper when a torque greater than a preset magnitude is exerted upon the coupling assembly.

14. The coupling as set forth in claim 12, wherein the first and second members define a dog clutch, and the respective teeth have oblique surfaces.

15. The coupling as set forth in claim 12, wherein the damper includes at least one spring that is axially compressible.

16. A marine drive comprising a housing, a shaft including a first section driven by a prime mover and a second section driven by the first section to drive a propulsion mechanism, the first and second sections being journaled by the housing to extend in series with each other, a first coupling member connected to one of the first and second sections by a first spline connection, a second coupling member connected to the other one of the first and second sections by a second spline connection, the first and second coupling members defining a clutch having engageable teeth, the respective teeth having oblique surfaces that are placed in a generally fully meeting position with each other for a unified rotation of the first and second sections, and a shock absorber disposed adjacent to the first coupling member, the first coupling member contacting the shock absorber and the oblique surfaces being slipped off from the fully meeting position when the first section rotates relative to the second section.

17. The marine drive as set forth in claim 16, wherein the shock absorber includes at least one spring disposed adjacent to the first coupling member.

18. The power transmission system as set forth in claim 1, wherein the damper and the second coupling member interpose the first coupling member therebetween.

19. The coupling as set forth in claim 12, wherein the drive and driven shafts have generally the same diameter as each other.

20. A marine drive comprising a housing, drive and driven shafts both journaled by the housing to extend in series with each other, a first coupling member slideably disposed on one of the drive and driven shafts and rotatable together with the associated drive or driven shaft, a second coupling member disposed on the other one of the drive and driven shafts and rotatable together with the associated drive or driven shaft, the first and second coupling members being engageable with each other to transmit torque from one of the first and second coupling members to the other one of the first and second coupling members, and a damper disposed on one of the drive and driven shafts next to the first coupling member, the first and second coupling members generally fully engaging with each other under a first condition that the drive shaft does not drive the driven shaft, the first coupling member sliding toward the damper to compress the damper and the first and second coupling members less engaging with each other than the first condition under a second condition that the drive shaft begins to drive the driven shaft.

21. A power transmission system for a marine propulsion unit having a powering element and a propulsion device, the system comprising a first shaft driven by the powering element, a second shaft driven by the first shaft and driving the propulsion device, the first and second shafts extending in series with each other and having a common rotational axis, a coupling combination defined on the first and second shafts to couple the first and second shafts together for rotation, and a damper disposed next to the coupling combination, the coupling combination including at least one coupling member axially moveable along the common axis relative to the first and second shafts in a direction toward the damper in response to movement of the first shaft relative to the second shaft, the coupling combination being generally fully completed when the coupling member does not move toward the damper, and the coupling combination being incompleted when coupling member moves toward the damper.

22. The power transmission system as set forth in claim 1 additionally comprising a rotational direction changing mechanism, the first shaft connected to the powering element through the rotational direction changing mechanism so that the first and second shafts are rotatable either one of two directions, the first and second coupling members including teeth engageable with each other, and the teeth having trapezoidal configurations.

23. The power transmission system as set forth in claim 12, wherein the tooth of the first coupling member includes at least first and second lateral sides, both sides being arranged to contact the second coupling member when the teeth of the first and second coupling members are in the generally fully meshing position.

24. The coupling as set forth in claim 12, wherein the first member moves back toward the second member and the tooth of the first member returns to the fully meshing position with the tooth of the second member when the drive shaft steadily drives the driven shaft.

* * * * *